US005752778A

United States Patent [19]

Brennan

[11] Patent Number: 5,752,778

[45] Date of Patent: May 19, 1998

[54] PRINTING APPARATUS

[75] Inventor: Robert Matthew Brennan, Dunstable, England

[73] Assignee: Esselte N.V., Sint-Niklaas, Belgium

[21] Appl. No.: 698,622

[22] Filed: Aug. 16, 1996

[30] Foreign Application Priority Data

Aug. 25, 1995 [GB] United Kingdom ..... 9517439

[51] Int. Cl.[6] ..... B41J 5/00

[52] U.S. Cl. ..... 400/477; 400/479; 340/825.29

[58] Field of Search ..... 400/472, 473, 400/477, 479; 340/825.29

[56] References Cited

U.S. PATENT DOCUMENTS

| | | | |
|---|---|---|---|
| 4,030,587 | 6/1977 | Walker | 197/1 R |
| 4,444,520 | 4/1984 | Hanakata et al. | 400/88 |
| 4,684,275 | 8/1987 | Matsushita et al. | 400/479 |
| 4,758,966 | 7/1988 | Brooks et al. | 400/229 |
| 4,853,695 | 8/1989 | Ueno et al. | 400/479 |
| 5,059,974 | 10/1991 | Wu | 400/479 |

FOREIGN PATENT DOCUMENTS

| | | |
|---|---|---|
| 0 119 293 | 9/1984 | European Pat. Off. . |
| 0 292 238 | 11/1988 | European Pat. Off. . |

OTHER PUBLICATIONS

Patent Abstracts of Japan, vol. 10, No. 110, 24 Apr. 1986, JPA 60 239867 (Mitsubishi Denki KK), 28 Nov. 1985.

Patent Abstracts of Japan, vol. 012, No. 432 (M-763), 15 Nov. 1988 JPA 63 166560 (Canon Inc), 9 Jul. 1988.

Patent Abstracts of Japan, vol. 016, No. 082 (M-1215), 27 Feb. 1992 JPA 03 264364 (Fujitsu General Ltd), 25 Nov. 1991.

*Primary Examiner*—John S. Hilten

*Attorney, Agent, or Firm*—Pennie & Edmonds LLP

[57] ABSTRACT

A printing device (2) for printing an image on an image receiving medium which includes a controller for generating a control signal defining the value of at least one parameter for controlling the device which has at least one characteristic in accordance with which a desired value of the parameter is selected. A keyboard matrix having a plurality of key connectors arranged in rows and columns with keys (6) arranged at intersections of the rows and columns is provided. The keys (6) can be actuated by a user to input to the controller data for controlling the printing device. Intersections each have an activated state when the associated key (6) is actuated and an inactive state when the associated key (6) is not actuated. An addiitional connector is provided which defines a set of intersections with said rows or said columns of key connectors so that at least one of said set of intersections is maintained in an activated state. The controller is arranged to determine which of the set of intersections is in an activated state to define the desired value of the parameter.

18 Claims, 3 Drawing Sheets

PRINTING APPARATUS

FIELD OF THE INVENTION

The present invention relates to printing apparatus and, in particular, is concerned with a tape printing apparatus.

BACKGROUND OF INVENTION

Known tape printing apparatus of the type with which the present invention is generally concerned are disclosed in EP-A-322918 and EP-A-322919 (Brother Kogyo Kabushiki Kaisha) and EP-A-0267890 (Varitronics). The printers each include a printing device having a cassette receiving bay for receiving a cassette or tape holding case. In EP-A-0267890, the tape holding case houses an ink ribbon and a substrate tape, the latter comprising an upper image receiving layer secured to a backing layer by an adhesive. In EP-A-322918 and EP-A-322919, the tape holding case houses an ink ribbon, a transparent image receiving tape and a double-sided adhesive tape which is secured at one of its adhesive coated sides to the image tape after printing and which has a backing layer peelable from its other adhesive coated side. With both these apparatus, the image transfer medium (ink ribbon) and an image receiving tape (substrate) are in the same cassette.

The present relates to a different type of tape printing apparatus which is described for example in EP-A-578372, the contents of which are herein incorporated by reference. In this printing apparatus, the substrate tape is similar to that described in EP-A-0267890 but is housed in its own tape holding case while the ink ribbon is similarly housed in its own tape holding case.

In these cases, the image receiving tape passes in overlap with the ink ribbon to a print zone consisting of a fixed print head and a platen against which the print head can be pressed to cause an image to transfer from the ink ribbon to the image receiving tape. There are many ways of doing this, including dry lettering or dry film impression, but the most usual way at present is by thermal printing where the print head is heated and the heat causes ink from the ink ribbon to be transferred to the ink receiving tape. Alternatively, the print head may be in direct contact with a thermally sensitive image receiving tape whereby when the print head is heated, an image is defined on the image receiving tape.

As discussed above, characters are printed on the image receiving tape when ink from the ink ribbon is melted by the thermal print head so as to be deposited on the image receiving tape in a pre-defined pattern. The print head generally comprises a number of printing elements which are selectively activatable (heatable) in order to provide the desired image on the image receiving tape. Where the ink ribbon is in contact with an activated printing element, a pixel will be printed on the image receiving tape at a location corresponding to the location of the activated printing element. The quality of printing is determined largely by the amount of energy used to melt the ink to deposit it onto the image receiving tape. The factors which determine the amount of energy used are the voltage applied to the printing elements of the print head, the resistance of those printing elements and the length of time for which the energy is applied to those printing elements. With current print head manufacturing processes, the resistance of the printing elements will vary from print head to print head. Accordingly, it is usual to compensate for the variations in the resistance of the printing elements from print head to print head to ensure that all tape printing apparatus manufactured provide a consistent quality of print. In order to compensate for variations in the resistance of the printing elements of the print head, either the voltage applied may be adjusted or the time for which energy is applied to the print head may be adjusted. This time is usually referred to as the strobe time.

In known tape printing apparatus, the voltage across the print head is kept constant while the strobe time is adjusted in the factory to compensate for resistance variations.

In one known tape printing apparatus, a microcontroller is arranged to control the strobe time. The microcontroller has a number of open circuit links or inputs equal to the number of different strobe time options which are preprogrammed into the microcontroller. The other end of each link is connected to a zero volt supply. In order to select a given strobe time, the link which corresponds to the selected strobe time option is shorted. The remaining links will be left in open circuit. In this way, the strobe time option which best compensates for the variation in the print head resistance can be selected. The selected link is usually shorted by the application of solder bridging a gap in the link. However, this method has the disadvantage that a microcontroller input line is required for each possible strobe time option. This undesirably increases the number of inputs to the microcontroller which also has a number of other inputs and outputs for controlling other parts of the tape printing apparatus. The complexity and cost of the tape printing apparatus can be increased by the provision of a microcontroller input for each strobe time option.

A binary method for the selection of an appropriate strobe time has also been proposed so that the number of links can be reduced. For example to implement eight strobe time options, three links are provided. Thus, depending on whether or not any of the links are shorted and, if so, which of the links are shorted, the microcontroller can ascertain which strobe time option has been selected. However, while reducing the number of input lines required, the selection of the required strobe time option is relatively complicated and not particularly suited to a factory environment. Errors resulting from the selection of the incorrect strobe time are more likely to occur with this method.

SUMMARY OF THE INVENTION

According to a first aspect of the present invention, there is provided a printing device for printing an image on an image receiving medium comprising: a controller for generating a control signal defining the value of at least one parameter for controlling the printing device which has at least one characteristic in accordance with which a desired value of the parameter is selected; and a keyboard matrix comprising a plurality of key connectors arranged in rows and columns with keys arranged at intersections of the rows and columns, which keys can be actuated by a user to input to the controller data for controlling the printing device, the intersections each having an activated state when the associated key is actuated and an inactive state when the associated key is not actuated; and an additional connector defining a set of intersections with said rows or the columns of key connectors, wherein at least one of the set of intersections is maintained in an activated state and wherein the controller is arranged to determine which of the set of intersections is in an activated state to define the desired value of the parameter.

By the simple addition of one additional connector which interacts with the keyboard matrix which is already provided, only one additional input to the microprocessor may be required to permit a number of different values of the parameter to be selected, as required. The cost of the controller generally increases in accordance with the number of input lines. By keeping the number of input lines to a minimum, the cost of the controller can be reduced as compared to the prior art. Additionally, the desired value of the parameter can easily be selected by maintaining one of the intersections of the additional connector in an activated state. This allows the selection of the desired value of the parameter to be carried out easily, particularly in a factory environment. Furthermore, the cost of including an additional connector is minimal particularly in those embodiments where the additional connector forms part of the keyboard matrix.

The parameter may be a parameter of a printing mechanism of the printing device. This parameter may be the amount of energy applied to the printing mechanism during each activation of the printing mechanism.

The parameter may be the voltage across the printing mechanism. However, it is preferred that the parameter be the length of time for which energy is applied to the printing mechanism for each activation thereof. It has been found that it is easier to control the length of time for which energy is applied to the printing mechanism as opposed to the voltage across the printing mechanism. The characteristic of the printing mechanism may be the resistance thereof. Thus, in various embodiments of the invention, it is possible to compensate for variations in the resistance of the printing mechanism by selecting an appropriate voltage or strobe time for each printing mechanism to ensure that a uniform print quality is achieved by the same models of the tape printing apparatus. It may be possible to ensure that the same energy level is applied to the print head of all tape printing apparatus of a particular model in this way. In some embodiments of the invention, a limited range of values for the voltage and/or strobe time is provided and the most appropriate value for the or each parameter is selected in accordance with the characteristic of the printing mechanism.

Alternatively the parameter may be a parameter of the printing device itself, the value of which is selected in accordance with at least one characteristic which may for example be the keyboard layout used. In some embodiments of the invention, different keyboard layouts are used for different languages. In these embodiments the selected value of the parameter would represent one of the possible keyboard layouts.

Preferably, the at least one intersection of the set of intersections of the additional connector is maintained in the activated state by connecting the additional connector to the respective row or column key connector at the at least one intersection. This connection may be achieved by the use of solder. In this way, it is easy for a factory worker to cause the desired value of the parameter to be selected for a given printing apparatus.

Each of the key connectors and the additional connector may be connected to the controller, whereby the controller is arranged to sequentially drive a signal on each of the connectors extending either row-wise or column-wise and the controller is arranged to read which of the other of the connectors extending column-wise or row wise is receiving the driven signal to determine which key is activated and/or which of the intersections of the additional connector is activated. In this way, the controller is able to determine not only which key is activated but also which intersection of the additional connector is activated so as to determine the selected value for the parameter. The printing mechanism can then be controlled in accordance with the selected value of the parameter.

The controller may be arranged to determine the number and position of the intersections of the set of intersections which are maintained in an activated state and to define the desired value of the parameter in accordance with the determination made by the controller. This embodiment is applicable to those arrangements in which there is no ambiguity in reading a keyboard even when more than one intersection of the set of intersections is activated. In this embodiment up to $2^n$ possible values of a given parameter can be selected where n is equal to the number of intersections in the set of intersections.

Embodiments of the present invention are particularly applicable to all kinds of tape printing apparatus.

According to a second aspect of the present invention, there is provided a method for setting a value of a parameter of a printing device, the printing device having a keyboard matrix comprising a plurality of key connectors arranged in rows and columns with keys arranged at intersections of the rows and columns which can be activated by a user for inputting data for controlling the printing device, the intersections each having an activated state when the associated key is actuated and an inactive state when the associated key is not actuated, the printed device further comprising an additional connector defining a set of intersections with the rows or said columns, the method comprising the steps of:

determining the value of a characteristic of the printing device;

selecting the value of the parameter in accordance with the measured value of the characteristic; and setting at one of the intersections of the additional connector in an activated state, whereby which of the set of intersections is in an activated state determines the value of the parameter.

In this way, a method of setting a parameter of a printing mechanism which can be easily implemented in the factory environment may be provided which does not require a large number of additional inputs to a controller.

BRIEF DESCRIPTION OF DRAWINGS

For a better understanding of the present invention and as to how the same may be carried into effect, reference will now be made by way of example to the accompanying drawings in which.

DESCRIPTION OF PREFERRED EMBODIMENT

Figure 1:
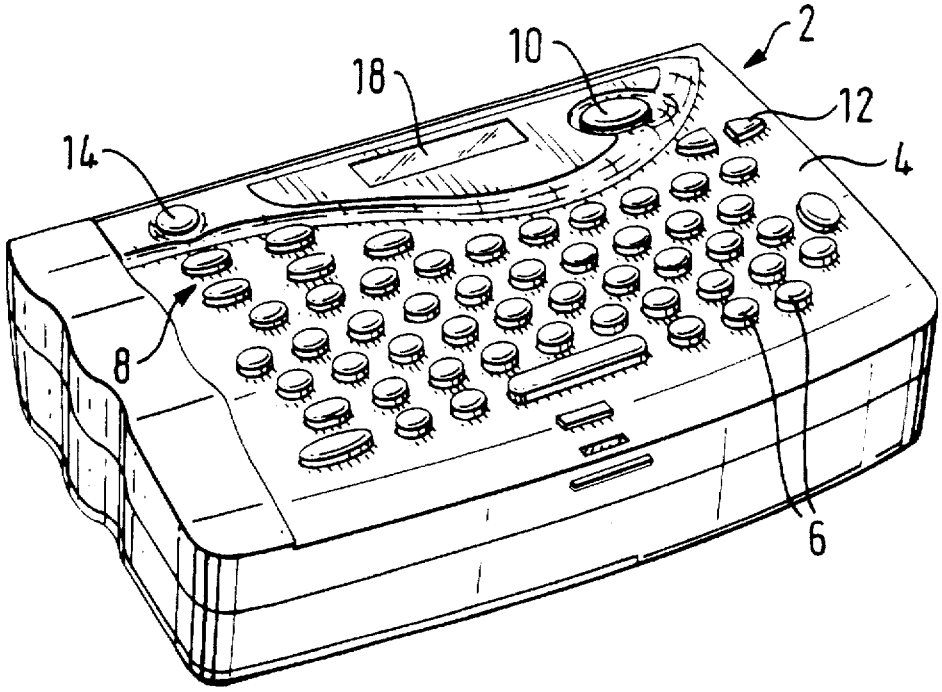
FIG. 1 is a plan view showing the front of a tape printing apparatus.

FIG. 1 shows a simplified plan view of a tape printing apparatus 2. The tape printing apparatus 2 comprises a keyboard 4. The keyboard 4 has a plurality of data entry keys and in particular comprises a plurality of numbered, lettered and punctuation keys 6 for inputting data to be printed as a label and function keys 8 for editing the input data. These function keys 8 are arranged for example to change the size or font of the input data. Additionally, these function keys 8 also allow, amongst other functions, underlining and boxing of the label to be achieved. The keyboard 4 also comprises a print key 10 which is operated when it is desired that a label be printed as well as tape feeding keys 12.

Additionally, the keyboard 4 also has an on/off key 14 for switching the tape printing apparatus 2 on and off.

The tape printing apparatus 2 also has a liquid crystal display (LCD) 18 which displays the data as it is entered. The display 18 allows the user to view all or part of the label to be printed which facilitates in the editing of the label prior to its printing. Additionally, the display 18 can also display messages to the user, for example, error messages or an indication that the print key 10 should be pressed. The display 18 is driven by a display driver 28 which can be seen in FIG. 3.

Figure 2:
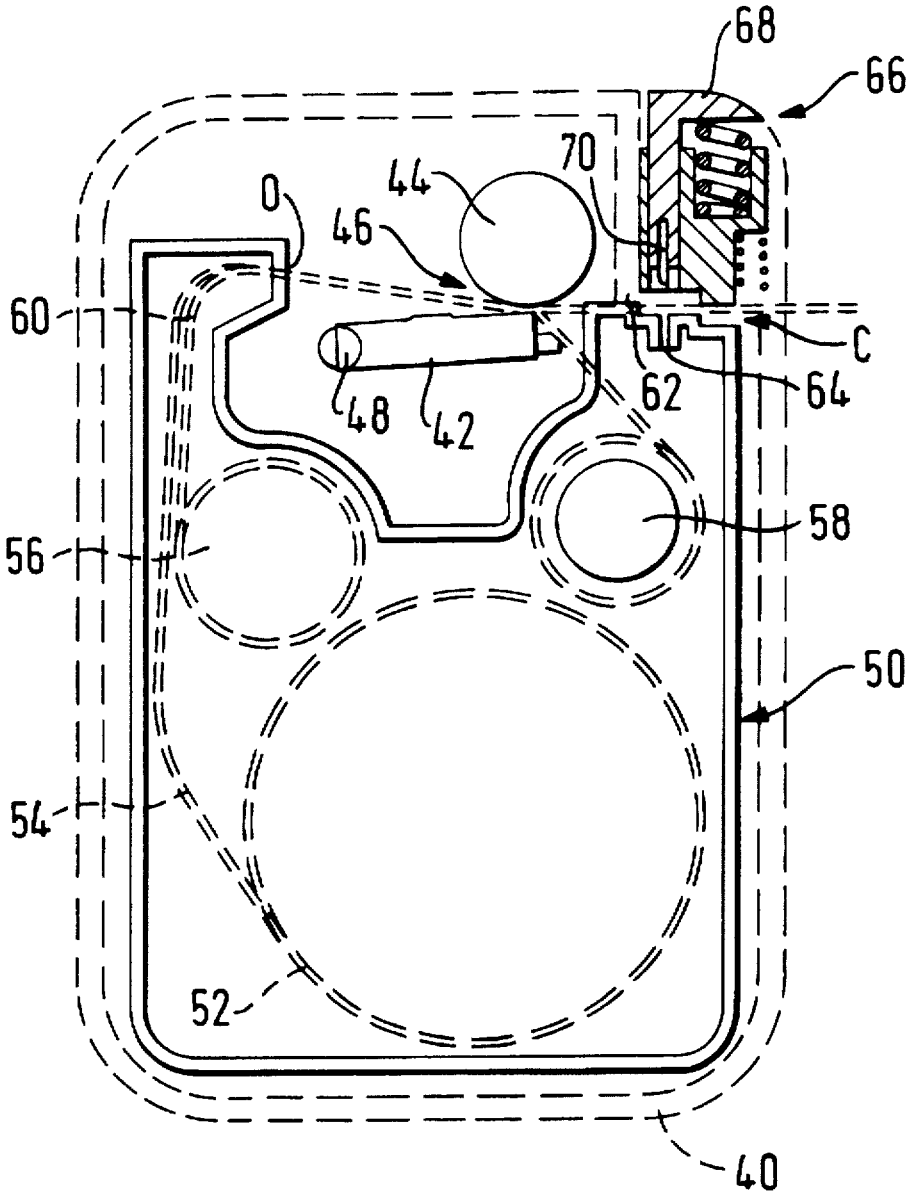
FIG. 2 is a plan view of the underside of the tape printing apparatus of FIG. 1.

On the underside of the tape printing apparatus 2 which can be seen from FIG. 2, there is a cassette receiving bay 40. The cassette receiving bay 40 includes a thermal print head 42 and a platen 44 which cooperate to define a print zone 46. The print head 42 is pivotable about a pivot point 48 so that it can be brought into contact with the platen 44 for printing and moved away from the platen 44 to enable a cassette to be removed and replaced. A cassette inserted into the cassette bay 40 is denoted generally by reference numeral 50. The cassette 50 holds a supply spool 52 of image receiving tape 54. The image receiving tape 54 comprises an upper layer for receiving a printed image on one of its surfaces and has its other surface coated with an adhesive layer to which is secured a releasable backing layer. The image receiving tape 54 is guided by a guide mechanism (not shown) through the cassette 50, out of the cassette 50 through an outlet 0, past the print zone 46 to a cutting location C. The same cassette 50 also has an ink ribbon supply spool 56 and ink ribbon take up spool 58. The image receiving tape 54 and the ink ribbon 60 are arranged to pass in overlap between the print head 42 and the platen 44. In particular, the image receiving layer of the image receiving tape 54 is in contact with the ink ribbon 60.

The platen 44 is driven by a motor 30 (see FIG. 3), for example a dc motor or a stepper motor so that it rotates to drive the image receiving tape 54 in a direction which is parallel to the lengthwise extent of the image receiving tape 54 through the print zone 46. In this way, an image is printed on the image receiving tape 54 and the image receiving tape is fed from the print zone 46 to the cutting location C provided at a location on a portion of the wall of the cassette 50 which is close to the print zone 46. The portion of the wall of the cassette 50 where the cutting location C is defined is denoted by reference 62. A slot 64 is defined in the wall portion 62 and the image receiving tape 54 is fed past the print zone 46 to the cutting location C where it is supported by facing wall portions on either side of the slot 64.

A cutting mechanism 66 is provided and includes a cutter support member 68 which carries a blade 70. The blade 70 cuts the image receiving tape 54 and enters the slot 64.

In those embodiments where the motor 30 is a dc motor, the image receiving tape 54 is driven continuously through the print zone 46 during printing. Alternatively, in those embodiments where the motor is a stepper motor, the platen 44 rotates stepwise to drive the image receiving tape 54 in steps through the print zone 46 during the printing operation.

The print head 42 is a thermal print head comprising a column of a plurality of printing elements which are selectively activatable in dependence on the image to be printed. The print head 42 is preferably only one printing element wide and the column extends in a direction perpendicular to the lengthwise direction of the image receiving tape 54. The height of the column of printing elements is preferably equal to the width of the image receiving tape 54 to be used with the label printing apparatus 2. Where more than one width of image receiving tape 54 is used, the print head column has a height equal to the largest width of tape 54. An image is printed on the image receiving tape 54 column by column by the print head 42. The print head 42 has a printing cycle having a first part (strobe time) in which the selected printing elements are activated and a second part in which none of the printing elements are activated.

As an alternative to the one cassette system shown in FIG. 2, the cassette receiving bay may be arranged to receive a separate image receiving tape cassette and a separate ink ribbon cassette which are arranged so that the ink ribbon and image receiving tape are passed in overlap through a print zone. This particular cassette arrangement is described for example in our European Patent Application No. 578372, the contents of which are herein incorporated by reference. Any other suitable arrangement for providing a supply of image receiving tape can of course be used with embodiments of the present invention.

Figure 3:
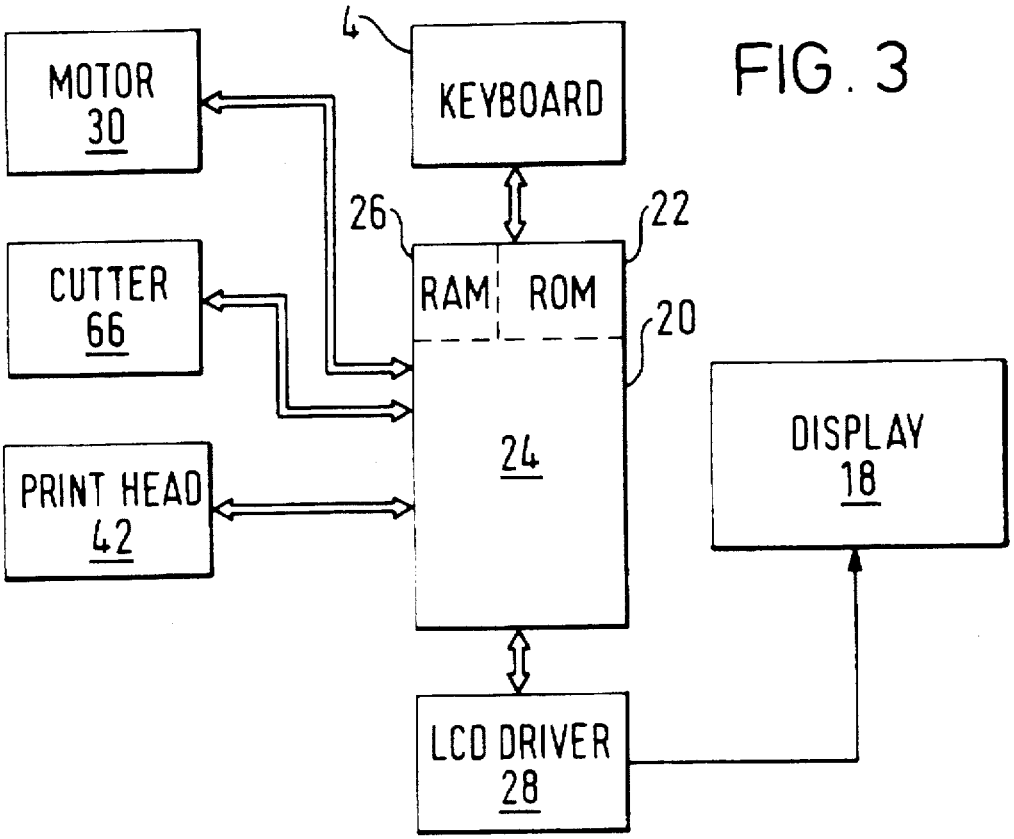
FIG. 3 is a simplified block diagram of control circuitry for controlling the tape printing apparatus of FIG. 1.

FIG. 3 shows the basic control circuitry for controlling the tape printing apparatus 2 of FIGS. 1 and 2. There is a microprocessor chip 20 having a read only memory (ROM) 22, a microprocessor 24 and random access memory capacity indicated diagramatically by RAM 26. The microprocessor 24 is controlled by programming stored in the ROM 22 and when so controlled acts as a controller. The microprocessor chip 20 is connected to receive label data input to it from the keyboard 4. The microprocessor chip 20 outputs data to drive the display 18 via the display driver chip 28 to display a label to be printed (or a part thereof) and/or a message or instructions for the user. The display driver chip 28 may be incorporated in the microprocessor chip 20. Additionally, the microprocessor chip 20 also outputs data to drive the print head 42 which prints an image onto the image receiving tape 54 to form a label. The data output to the print head 42 defines which of the printing elements are to be activated and the duration of the first part of the printing cycle. This will be discussed in more detail hereinafter. Finally, the microprocessor chip 20 also controls the motor 30 for driving the image receiving tape 54 through the tape printing apparatus 2. The microprocessor chip 20 may also control the cutting mechanism 66 to allow lengths of image receiving tape 54 to be cut off after an image has been printed thereon. It should be appreciated that the cutter mechanism can alternatively be manually operated.

Figure 4:
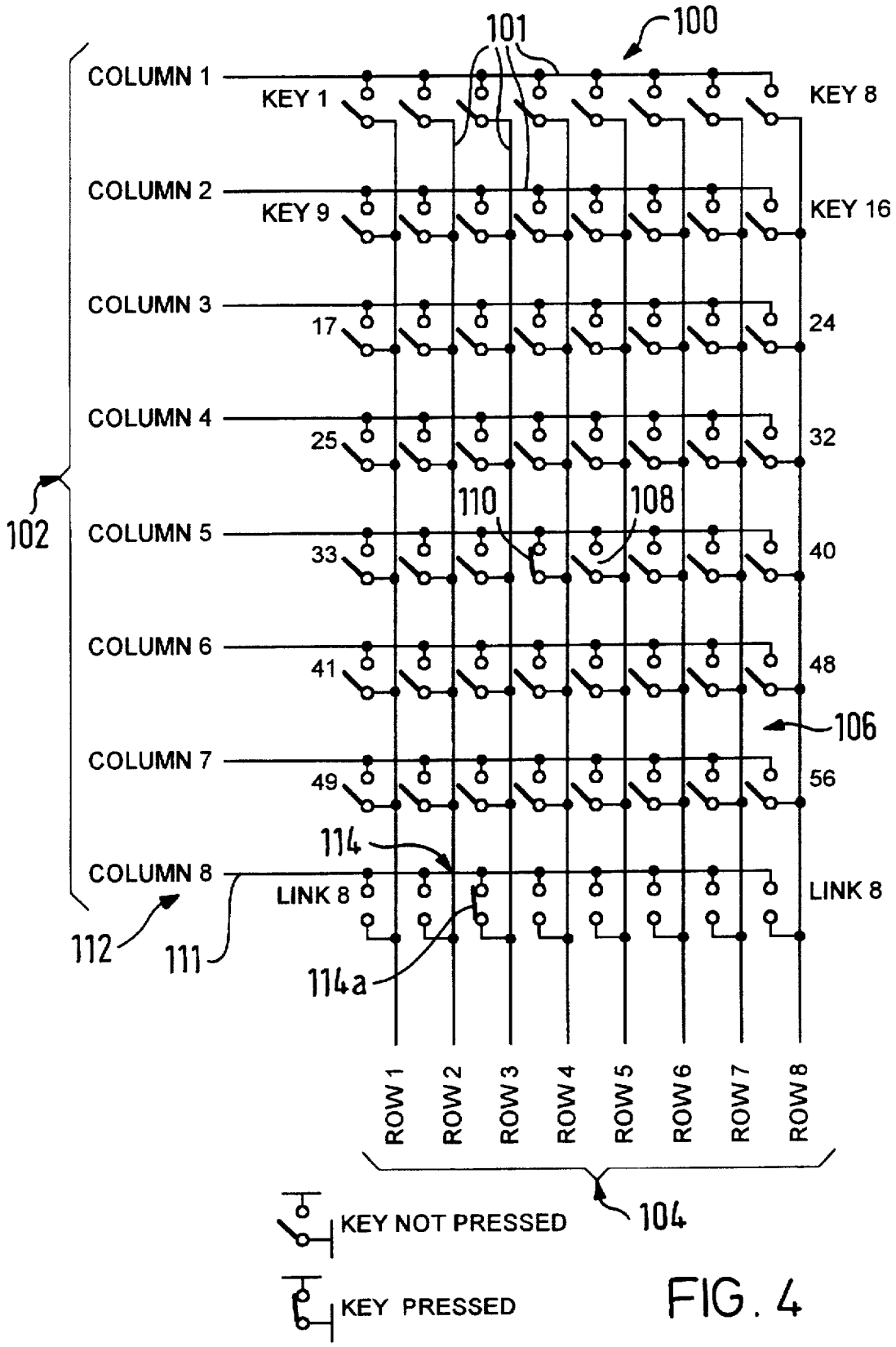
FIG. 4 shows a keyboard matrix of a keyboard of the tape printing apparatus of FIG. 4.

The keyboard 4 has a keyboard matrix 100 which can be seen from FIG. 4. This keyboard matrix 100 has key connectors 101 arranged in seven columns 102 and eight rows 104. An intersection 106 is provided where each row 104 crosses each column 102. Thus, a total of fifty-six intersections 106 are provided. These intersections have an activated state and an unactivated state which are controlled by the keys 6 and 8. In particular, depression of a key 6 or 8 will put the corresponding intersection into an activated state. In fact, each key may be regarded as a switch which is either open (unactivated), see intersection 108, or closed (activated), see intersection 110. Each key connector 101 is connected to the microprocessor chip 20 so as to supply the input data to that microprocessor chip 20 for processing prior to printing.

In order to determine which, if any, of the keys 6 or 8 are depressed, the microprocessor chip 20 periodically drives a sequence of signals on to each of the key connectors 101 arranged in columns 102 in turn. The microprocessor chip 20 will sequentially drive signals through each of the seven key connectors 101 arranged in columns 102 and as a signal is driven on each key connector 101 arranged in a column 102, the microprocessor chip 20 will interrogate, at the same time all key connectors 101 of the eight rows 104 in order to search for the depressed key 6 or 8 (or closed intersection). The microprocessor 20 is able to detect which, if any, key connector 101 arranged in a row 104 is receiving the driven signal. As the microprocessor chip 20 knows which key connector 101 arranged in a column 102 has a signal driven thereon at a particular time and determines which key connector 101 arranged in a row 104 receives the driven signal, the microprocessor chip 20 is able to ascertain which intersection 106 and accordingly which associated key 6 or 8 is being activated.

There is also an additional connector 111 arranged in a column 112 which is provided so as to allow the length of the first part (strobe time) of the printing cycle in which the selected printing elements are activated to be selected. No keys are associated with this additional connector 111. As discussed earlier, the quality of printing carried out by the print head 42 is determined, to a large extent, by the amount of energy applied to the printing elements to melt the ink of the ink ribbon 60 or to react with a thermally sensitive image receiving tape. The factors which determine the energy applied to the printing elements are the voltage applied to the printing elements, the resistance of those elements and the time for which the energy is applied. As the resistance varies from print head 42 to print head 42, it is desirable to compensate in the factory for those variations in resistance so as to ensure that all tape printing apparatus leaving a factory will provide the same or similar quality print. In some embodiments it is preferable to maintain the energy level applied to the print head 42 constant. The voltage applied would then generally be the same for all tape printing apparatus. The strobe time is then varied to compensate for the variations in print head 42 resistance to ensure that all models of the same tape printing apparatus apply the same energy level to the print head 42. Thus, the length of the first part i.e. the strobe time of the printing cycle in which the printing elements are activated is varied in the factory in accordance with the resistance of the print head 42. In the factory, measurements are made to determine the resistance of the print head 42 and from the measured resistance, it is determined how long the first part or strobe time of the printing cycle should be. The strobe time may be selected in the factory in which the tape printing apparatus is made and not the factory where the print head is made.

The additional connector 111 allows the desired length of the first part of the printing cycle to be selected in accordance with the measured resistance of the printing elements of the print head 42. The additional connector 111 intersects the eight key connectors 101 arranged in rows 104 of the keyboard matrix 100. However, the intersections 114 of the additional connector 111 with the eight key connectors 101 arranged in rows 104 are not activated by any of the keys 6 and 8. Rather, each intersection 114 represents one possible value for the length of time of the first part (strobe time) of the printing cycle. In order to select the desired value for the first part of the printing cycle, one of the intersections 114 of the additional connector 111 is put into a permanently activated state by short circuiting connector 111 with the intersected key connector 101 arranged in a row 104 at the respective intersection 114. In other words, each of the eight intersections 114 of the additional connector 111 represents a possible strobe time selecton.

The microprocessor chip 20 is arranged additionally to drive a signal on to the additional connector 111 along with the other key connectors 101 arranged in columns 102. Thus, the microprocessor chip 20 drives a sequence of signals on to each of the key connectors 101 arranged in the columns 102 and the additional connector 111. In exactly the same way as discussed above in relation to the determination as to which key 6 or 8 is depressed, the microprocessor chip 20 is able to ascertain which of the intersections 114 of the additional connector 111 is activated (short circuited) by detecting which key connector 101 arranged in a row 104 receives the signal driven on the additional connector ill. Once the microprocessor chip 20 has ascertained which intersection 114 of the additional connector 111 is short circuited or activated, the duration of the first part (strobe time) of the printing cycle is set. The microprocessor chip 20 is preprogrammed with the various strobe times, stored in the ROM 22, associated with the respective intersections 114 so that when a particular intersection 114 is selected, a preprogrammed strobe time associated with that intersection 114 is accessed. Information concerning the duration of the first part or strobe time of the printing cycle forms part of the data which is supplied to the print head 42.

Thus, use of the additional connector 111 in order to select the most appropriate duration of the first part of the printing cycle only requires one additional input to the microprocessor chip 20. Additionally, the costs involved in adding an additional line to the keyboard matrix are minimal.

The short circuiting of the respective intersection 114 of the additional connector 111 can be achieved simply by the application of solder to the selected intersection 114. The gap between the additional connector 111 and respective row key connectors 101 is relatively small in the region of the intersections 114 so that solder can easily bridge the gap of the selected intersection. Intersection 114*a* of FIG. 1 has been activated and as can be seen, the respective row key connector 101 is connected to the additional connector 111.

Thus, in the factory environment, the resistance of the print head 42 is determined. The print head may be sold on to a manufacturer of a tape printing apparatus. The most appropriate strobe time for the print head 42 is determined in accordance with the measured resistance. In particular, it is determined which one of the eight preprogrammed strobe times is best able to compensate for the variation of the resistance of the print head 42 from a specified resistance value. The factory worker then applies solder to the intersection 114 of the additional line 111 corresponding to the determined strobe time to thereby activate the respective intersection 114. When the tape printing apparatus 2 is used, the selected strobe time of the print head 42 is able to compensate for variations in the resistance of the print head 42 from the specified resistance value so that all produced tape printing apparatus 2 will provide a similar quality of print as the energy applied to the print head 42 is the same. The selected strobe time for the activation of the print head 42 forms part of the control information output by the microprocessor chip 20 for controlling the print head 42 along with control information concerning which of the printing elements are to be activated in a given printing cycle.

To avoid ambiguities occurring in the reading of the keyboard, this embodiment of the invention is arranged so that during normal operation of the tape printing apparatus, the user is never required to depress more than one key at the same time. If more than one actuated key is detected, then any strobe time value decoded is ignored. Likewise, this embodiment of the invention is devised so that only one strobe time link is short circuited so as to prevent ambiguities in reading the keyboard.

However, it should be noted that depending on the construction of the keyboard and the method used to determine activated states of the intersections of the key connectors, it may be possible to determine which keys have been depressed without ambiguity even when two or more keys are depressed simultaneously. Likewise it may be possible to have two or more intersections of the additional connector short circuited without giving rise to ambiguity. Thus, with a total of eight intersections between the key connectors arranged in rows and the additional connector, it may be possible to have 256 different values for the parameter. The value of the parameter would be determined in dependence of the number of intersections which have been short circuited as well as which of the intersections have been short circuited.

It will be appreciated that in certain embodiments, more than one additional column may be provided either to increase the number of possible values for a parameter or so that the value of more than one parameter can be selected. Additionally, it is possible to vary other parameters of the printing mechanism in a similar way, for example the voltage applied to the print head. In this embodiment, the strobe time may be kept constant. Other parameters of the tape printing device may be similarly controlled. For example, different keyboard layouts may be required for use with different languages. For example different keyboard layouts with different keys may be required for the French, English and German languages. In these circumstances an indication needs to be provided to the microprocessor as to which keyboard layout is provided as the tape printing apparatus are otherwise identical. An additional connector can, in the same manner as described in relation to the selection of the strobe time, be used to indicate to the microprocessor which keyboard layout the tape printing apparatus has.

Embodiments of the present invention may be applicable to embodiments where an image is directly printed on to an image receiving tape without the use of an ink ribbon. It should be appreciated that the resistance of the print head and the strobe time may be determined in the same factory.

What is claimed is:

1. A printing device for printing an image receiving medium comprising:

a controller for generating a control signal defining the value of at least one parameter for controlling the device which has at least one characteristic in accordance with which a desired value of said parameter is selected; and a keyboard matrix comprising a plurality of key connectors arranged in rows and columns with keys arranged at intersections of said rows and columns, which keys can be actuated by a user to input to the controller data for controlling the printing device, said intersections each having an activated state when the associated key is actuated and an inactive state when the associated key is not actuated; and an additional connector defining a set of intersections with said rows or said columns of key connectors wherein at least one of said set of intersections is permanently maintained in an activated state and wherein said controller is arranged to determine which of the set of intersections is in an activated state to define the desired value of said parameter.

2. A printing device as claimed in claim 1 wherein said parameter is a parameter of a printing mechanism of the printing device.

3. A printing device as claimed in claim 2, wherein said parameter comprises the amount of energy applied to said printing mechanism during each activation of the printing mechanism.

4. A printing device as claimed in claim 2, wherein said parameter is the voltage across the printing mechanism.

5. A printing device as claimed in claim 2, wherein said parameter is the length of time for which energy is applied to the printing mechanism for each activation thereof.

6. A printing device as claimed in claim 2, wherein said characteristic of said printing mechanism is the resistance thereof.

7. A printing device as claimed in claim 1 wherein said characteristic comprises keyboard layout and the value of the parameter is selected in accordance with the particular keyboard layout provided for said printing device.

8. A printing device as claimed in claim 1, wherein said at least one intersection of said set of intersections of the additional connector is maintained in said activated state by connecting said additional connector to the respective row or column key connector at the said at least one intersection.

9. A printing device as claimed in claim 1, wherein said intersections of said key connectors are activated by depressing the associated key.

10. A printing device as claimed in claim 1, wherein each of said key connectors and said additional connector are connected to said controller whereby said controller is arranged to sequentially drive a signal on each of said connectors extending either row wise or column wise and the controller is arranged to read which of the other of said connectors extending column wise or row wise is receiving the driven signal to thereby determine which key is activated and/or which of said intersections of the additional connector is activated.

11. A printing device as claimed in claim 1, wherein said connector forms part of said keyboard matrix.

12. A printing device as claimed in claim 1, wherein said printing device is operable to print an image on an image receiving tape.

13. A printing device as claimed in claim 1, wherein the controller is arranged to determine the number and position of the intersections of the set of intersections maintained in an activated state and to define the desired value of the parameter in accordance with the determination made by said controller.

14. A method for setting a value of a parameter of a printing device, said printing device having a keyboard matrix comprising a plurality of key connectors arranged in rows and columns with keys arranged at intersections of said rows and columns which can be activated by a user for inputting data for controlling the printing device, said intersections each having an activated state when the associated key is actuated and an inactive state when the associated key is not actuated, said printing device further comprising an additional connector defining a set of intersections with said rows or said columns of key connectors, said method comprising the steps of:

determining the value of a characteristic of said printing device;

selecting the value of said parameter in accordance with the determined value of said characteristic; and setting at least one of said intersections of said additional connector in a permanently activated state, whereby which of the set of intersections is in an activated state determined the value of said parameter.

15. A printing device for printing an image on an image receiving medium comprising:

a printing mechanism for printing an image on said image receiving medium;

a controller for generating a control signal defining the value of at least one parameter of said printing mechanism for controlling the printing mechanism which has at least one characteristic in accordance with which a desired value of said parameter is selected;

a keyboard matrix comprising a plurality of key connectors arranged in rows and columns with keys arranged at intersections of said rows and columns, which keys can be actuated by a user to input to the controller data for controlling the printing device, said intersections each having an activated state when the associated key is actuated and an inactive state when the associated key is not actuated; and an additional connector defining a set of intersections with said rows or said columns of key connectors wherein at least one of said set of intersections is maintained in a activated state and wherein said controller is arranged to determine which of the set of intersections is in an activated state to define the desired value of said parameter.

16. A printing device as claimed in claim 15 wherein said parameter comprises the amount of energy applied to said printing mechanism during each activation of the printing mechanism.

17. A printing device as claimed in claim 15, wherein said parameter is the voltage across the printing mechanism.

18. A printing device for printing an image receiving medium comprising:

a controller for generating a control signal defining the value of at least one parameter for controlling the device which has at least one characteristic in accordance with which a desired value of said parameter is selected; and a keyboard matrix comprising a plurality of key connectors arranged in rows and columns with keys externally of said device arranged at intersections of said rows and columns, which keys can be actuated by a user to input to the controller data for controlling the printing device, said intersections each having an activated state when the associated key is actuated and an inactive state when the associated key is not actuated; and an additional connector defining a set of intersections with said rows or said columns of key connectors wherein at least one of said set of intersections is maintained in a activated state and wherein said controller is arranged to determine which of the set of intersections is in an activated state to define the desired value of said parameter whereby the state of the activated intersection is set internally of said device by connecting said additional connector to the respective row or column key connector at the said at least one intersection.

* * * * *